United States Patent [19]

Silva et al.

[11] Patent Number: 4,575,144

[45] Date of Patent: Mar. 11, 1986

[54] DEVICE FOR ATTACHING A LIFTING MEANS TO A LOAD

[76] Inventors: Edwin L. Silva, Rte. 2, Box 46A, Yoncalla, Oreg. 97499; Fred D. Silva, 16142 Via Descanso, San Lorenzo, Calif. 94580

[21] Appl. No.: 593,510

[22] Filed: Mar. 26, 1984

[51] Int. Cl.[4] ..... B66C 1/10

[52] U.S. Cl. ..... 294/97; 294/89; 294/93

[58] Field of Search ..... 294/97, 96, 95, 94, 294/93, 92, 89, 82 R, 83 R, 825 F, 86.24, 86.25, 62, 15, 16, 13, 27 R; 52/125, 707; 410/101, 103, 105, 116, 102

[56] References Cited

U.S. PATENT DOCUMENTS

| | | | |
|---|---|---|---|
| 764,281 | 7/1904 | Duncan | 294/89 |
| 2,404,775 | 7/1946 | Ehmann | 294/89 |
| 2,563,164 | 8/1951 | Lewis-Fletcher | 294/89 |
| 4,300,382 | 11/1981 | Meek | 294/97 |
| 4,304,432 | 12/1981 | Silva | 294/93 |

*Primary Examiner*—James B. Marbert

*Attorney, Agent, or Firm*—James D. Givnan, Jr.

[57] ABSTRACT

A device for attaching a lifting cable to a load. Lifting forces are imparted through a pair of inclined surfaces of the device which surfaces engage like surfaces on the load being lifted. A main member houses positionable member which has one of the inclined surfaces thereon and may be rotated for insertion below an inclined surface on the load. The main member has the remaining lifting inclined surface thereon. A locking member is slidably mounted on a main member of the device and gravitates into a position whereat the positionable member is prevented from movement. The lifting cable passes through openings in the movable, locking and main members of the device. A bolt equipped clevis may be coupled to said members.

9 Claims, 9 Drawing Figures

DEVICE FOR ATTACHING A LIFTING MEANS TO A LOAD

BACKGROUND OF THE INVENTION

The present invention pertains generally to devices for coupling a lift cable or hook to a heavy article to be lifted such as metal plate.

A problem exists in handling steel plate as the same must be modified to accept a lifting instrumentality and when so modified the plates are not stackable by reason of an irregular surface.

A proposed solution is disclosed in U.S. Pat. No. 4,304,432 issued to one of the present inventors which patent discloses, inter alia, a three-piece device having a pair of lift elements and a central locking element. A flexible member yieldably connects the three pieces and permits displacement of same during attachment to an undercut opening on a metal plate. The patented device described is not in wide use in the construction trades for one reason or another. Such devices are subjected to very hard use in the field and must withstand extremely rough treatment.

U.S. Pat. No. 2,563,164 discloses a lifting attachment with dovetailed members spaced by a centrally disposed key member all joined by a pin.

SUMMARY OF THE PRESENT INVENTION

The present invention is embodied in a lifting device for lifting heavy articles such as steel plates and other articles not having lift attachment points.

The device includes multiple lifting surfaces which are positionable into abutting engagement with cooperating surfaces on the article to be lifted. Said article may be provided with a lifting plate cast with inclined lifting surfaces to preclude forming such surfaces on the article. Preferably, the plate is attached to the article to be lifted in a recessed manner so as to not alter the article's planar configuration which is important in the case of stacked steel plates of the type used by those in heavy construction to cover excavations in roadways, streets, etc.,. A main member of the present device carries a juxtaposed locking member with guide means confining said locking member for travel between locking and unlocking extremes of travel. A positionable member of the device may move in a rocking manner about a transverse axis thereof into abutting engagement with an inclined surface and thereafter is secured against movemtn during operation by said locking menber.

Important objectives include the provision of a lifting device to facilitate attachment of a lift cable to an article to be lifted which device is of rugged construction and affords positive engagement with inclined surfaces on the lifted article; the provision of a lifting device which lends itself to low cost casting operations and which withstands the severe conditions encountered by lifting components used in heavy construction; the provision of a lifting device having a weighted locking member entrained for limited movement in an upright plane into and out of a lock position between bevelled lifting surface of the device.

DETAILED DESCRIPTION OF THE PREFERRED EMBODIMENT

Figure 1:
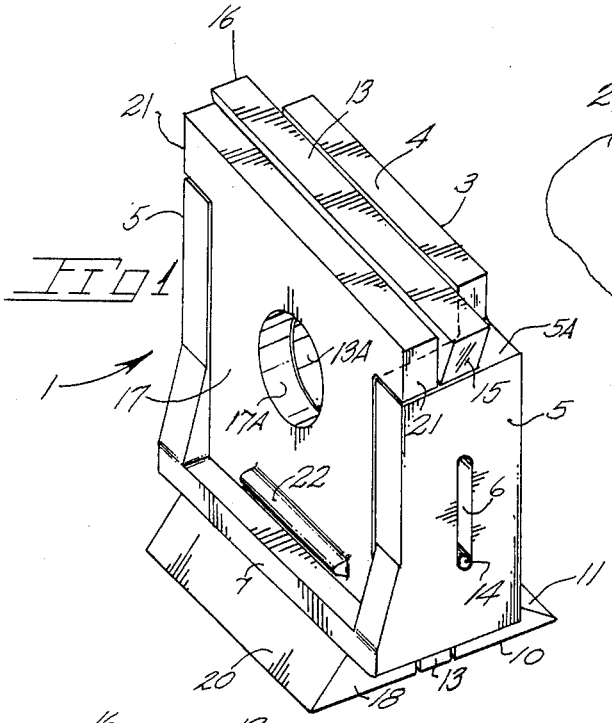
FIG. 1 is a downward perspective view of the present device.
Figure 2:
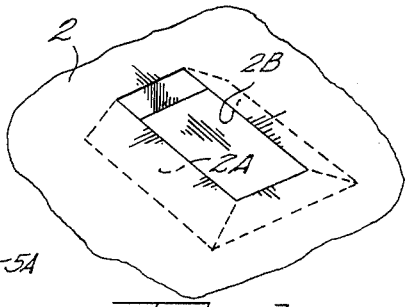
FIG. 2 is a perspective view on a reduced scale of a fragment of an article to be lifted by the present device.
Figure 3:
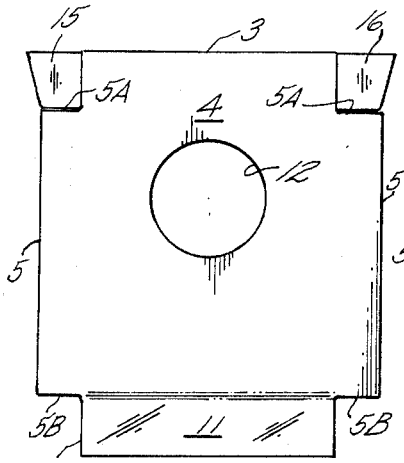
FIGS. 3 and 4 are front and rear elevational views thereof.
Figure 4:
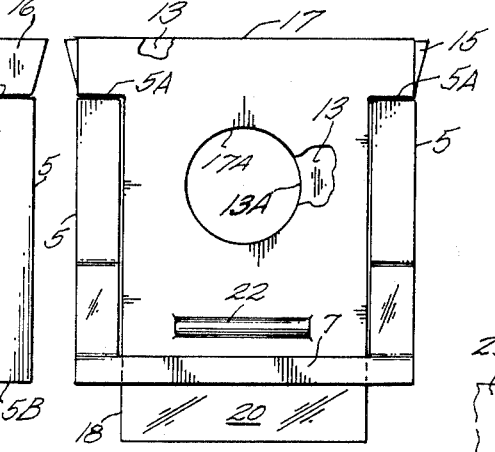

With continuing reference to the drawing wherein applied reference numerals identify parts hereinafter similarly identified, the reference numeral 1 indicates generally the present device apertured to receive a lifting instrumentality such as a lift cable or hook. A typical body or article to be lifted is provided with an attachment plate indicated at 2. The lifted body may be of any shape or size. The plate has upwardly and inwardly inclined engageable surfaces 2A-2B.

A main member 3 of the device may be cast construction having an upright rear wall 4, side walls as at 5, with each side wall defining an upright slotted opening as at 6. A retainer bar 7 interconnects the side walls at their lower, outermost ends. Said main member defines an internal open area within which is slidably confined major portions of a later described locking member and a positionable member. The side walls terminate upwardly in horizontal surfaces 5A. Said main member includes a depending inclined or bevelled portion 10 having a surface 11 extending outwardly and downwardly from rear wall member 4. Said main member is apertured at 12 to receive a lifting instrumentality such as a cable or the like. A shoulder 5B defines the lower limit of side walls 5 and may rest on article 2 during use of the device.

A locking member at 13 is of planar shape and constrained for movement in an upright plane by stop means shown as pins 14 which project oppositely from the locking member sides into limited sliding engagement with the elongate upright opening 6 formed in each side wall. Locking member 13 is held in sliding juxtaposition with main member wall 4.

Figure 5:
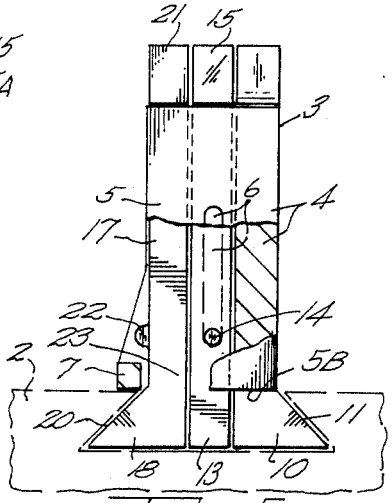
FIG. 5 is a side elevated view thereof with fragments broken away.

The locking member includes ears at 15 and 16 which facilitate manual grasping and lifting of the locking member with each ear having a lower surface for supported, rested engagement on side wall surface 5A. In its lowermost position of FIGS. 1 and 5, the locking member prevents opening arcuate movement of a following described positionable member relative to main member 3 of the device.

A positionable member at 17 includes a depending bevelled portion 18 having an upwardly disposed inclined or bevelled surface 20 for extending downwardly and outwardly for operational engagement with a similarly inclined surface (2A or 2B) on an article or body being lifted. Laterally extending appendages 21 at the upper end of the positionable member rest upon side wall surfaces 5A. A retainer rib 22 engages retainer bar 7 on the main member to prevent downward axial disengagement of the positionable member through a main member defined by the side walls 5, retainer bar 7 and main member wall 4.

Figure 8:
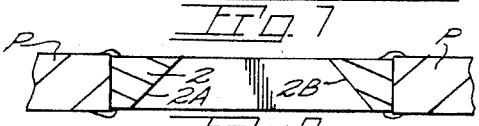
Figure 9:
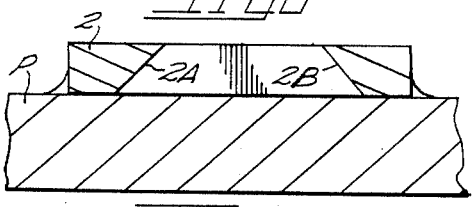

Indicated in FIG. 8 is an attachment plate 2 shown secured to a structure to be lifted, such as a steel plate P of the type used by road contractors to cover excavated areas. The attachment plate is preferably welded in a recessed manner to permit uninterrupted flat stacking of the large metal plates in surfacial abutment with one another. If such stacking is not required, then the attachment plate 2 may be secured as by welding to a surface area of the lifted article as shown in FIG. 9. If so desired, the article or body to be lifted may be formed with inclined surfaces directly thereon to receive the inclined surfaces 20 and 11 of the lifting device.

Figure 6:
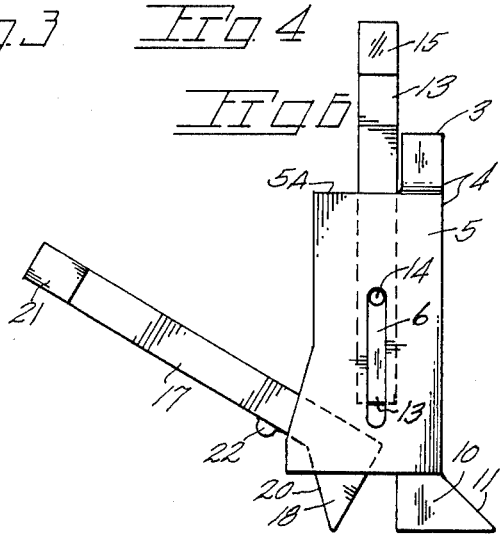
FIG. 6 is a view similar to FIG. 4 but with the device reconfigured for attachment purposes.
Figure 7:
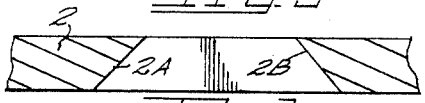
FIGS. 7, 8 and 9 are vertical sections of inclined lifted surfaces on an article to be lifted.

In use, the locking member 13 is manually lifted whereupon the lifting device and specifically main member 3 tipped forwardly to enable insertion of the depending bevelled member 10 into inserted engagment with a plate cooperating bevelled surface. Positionable member 17 is rotated outwardly or rearwardly away from side walls 5 to the FIG. 6 position to permit the depending bevelled portion 18 thereon to be located into the plate opening. With the main member 3 disposed perpendicularly to the attachment plate 4 rotation of the positionable member upwardly to its normal upright position about a transverse axis results in the bevelled depending portion surface 20 thereon moving into abutting engagement with the plate bevelled surface as at 2A. Lastly, locking member 13 is released to descend into locking, interposed relationship with the positionable and main member. A lifting instrumentality such as a cable or hook may then be passed through aligned apertures 13A and 17A in the locking member and positionable member in alignment with the main member opening 12. A cable clevis bolt may extend through the openings.

While we have shown but one embodiment of the invention it will be apparent to those skilled in the art that the invention may be embodied still otherwise without departing from the spirit and scope of the invention.

Having thus described the invention, what is desired to be secured under a Letters Patent is:

We claim:

1. A lifting device for removable attachment to a body to be lifted having device engaged surfaces thereon, said device comprising, a main member having an open area defined by side walls and a rear wall the latter being integral with said side walls and having a depending portion located below the side walls and having an inclined surface thereon, a positionable member normally located between said side walls and having a downwardly and outwardly inclined surface for body engagement, a locking member located between said side walls and positionable relative said main member and operable to prevent relative movement between the main and positionable members during a lifting operation, stop means constraining the locking member for movement in an upright plane, and retainer means acting on said positionable member to limit movement thereof in one direction while permitting rotational movement of same about a transverse axis of the positionable member during installation and removal of said positionable member inclined surface relative to a cooperating surface on a body to be lifted.

2. The device claimed in claim 1 wherein said retainer means includes a retainer bar carried by said side walls.

3. The device claimed in claim 1 wherein said stop means is embodied in pin means disposed within an elongate slot in said main member.

4. The device claimed in claim 2 wherein said retainer means additionally includes a projection on said postionable member engageable with the bar on said main member to prevent downward displacement of the positionable member when rotated away from the locking member.

5. The device claimed in claim 1 additionally including an attachment plate affixed to said body to be lifted, said plate inset within the body to be lifted and having inclined surfaces thereon engaged by like surfaces on said positionable and main members,

6. A lifting device for engagement with a body to be lifted having upwardly inclined lifting surfaces thereon, said device comprising, a main member having side walls and a rear wall defining an open area, a depending portion with an inclined lifting surface thereon, a locking member in juxtaposition with said main body member rear wall, stop means coupling said locking member to said main member for limited travel of the locking member in an upright plane, a positionable member in said open area having an inclined lifting surface thereon, and appendages on said locking member and said positionable member for rested engagement with said main member.

7. The lifting device claimed in claim 6 wherein said stop means includes a pin, at least one of said side walls defining a close ended upright slot within which said pin may travel.

8. The lifting device claimed in claim 6 wherein said main member includes a bar extending intermediate said side walls, means on said positionable member engageable with said bar to limit movement of said positionable member.

9. The lifting device claimed in claim 8 wherein said means on said positionable member is a rib on said positionable member, said rib engageable with said bar to limit axial travel of the positionable member.

* * * * *